US005828304A

United States Patent [19]

Mowday

[11] Patent Number: 5,828,304

[45] Date of Patent: Oct. 27, 1998

[54] POOL MONITORING SYSTEM

[76] Inventor: Ruth I. Mowday, 49 Seneca Ave., Coatesville, Pa. 19320

[21] Appl. No.: 954,148

[22] Filed: Oct. 20, 1997

Related U.S. Application Data

[63] Continuation-in-part of Ser. No. 820,162, Mar. 19, 1997, abandoned.

[51] Int. Cl.[6] ..... G08B 13/20; G08B 21/00

[52] U.S. Cl. ..... 340/566; 340/539; 340/540; 340/565; 340/573

[58] Field of Search ..... 340/566, 565, 340/540, 539, 573

[56] References Cited

U.S. PATENT DOCUMENTS

| | | | |
|---|---|---|---|
| D. 359,702 | 6/1995 | Brandon | D10/106 |
| 5,049,859 | 9/1991 | Arnell | 340/573 |
| 5,115,222 | 5/1992 | Peralta et al. | 340/573 |
| 5,121,104 | 6/1992 | Nelson et al. | 340/566 |
| 5,268,673 | 12/1993 | Nelson et al. | 340/566 |
| 5,325,086 | 6/1994 | Thomas | 340/565 |

*Primary Examiner*—Glen Swann

[57] ABSTRACT

A pool monitoring system including a monitoring unit with a detection mechanism adapted to transmit an alarm signal upon the detection of a human falling within the body of water. Further provided is a timer deactivation mechanism having a first mode of operation during which an activation signal is transmitted, wherein the activation signal is transmitted only while the timer deactivation mechanism is maintained in the first mode of operation. The timer deactivation mechanism further has a second mode of operation initiated by the receipt of a timer deactivation signal via free space. The timer deactivation mechanism is further maintained in the second mode of operation during a time period inherent in the timer deactivation signal. Also included is a transmitter mechanism connected to the sound detection mechanism and timer deactivation mechanism. The transmitter mechanism is adapted to transmit via free space a remote alarm activation signal upon the receipt of the alarm signal from the sound detection mechanism coincident with the receipt of the activation signal from the timer deactivation mechanism. Lastly, a remote alarm unit is situated distant the monitoring unit and includes a timer selection mechanism adapted to transmit via free space the deactivation signal indicative of the predetermined time period. The remote alarm unit further includes a remote receiver mechanism adapted to generate an audible noise upon the receipt of the remote alarm activation signal via free space.

8 Claims, 3 Drawing Sheets

POOL MONITORING SYSTEM

RELATED APPLICATIONS

The present application is a continuation-in-part application of an application filed Mar. 19, 1997 under Ser. No. 08/820,162, now abandoned.

BACKGROUND OF THE INVENTION

1. Field of the Invention

The present invention relates to a pool monitoring system and more particularly pertains to monitoring a pool from afar.

2. Description of the Prior Art

The use of pool monitoring devices is known in the prior art. More specifically, pool monitoring devices heretofore devised and utilized for the purpose of for indicating when a person has fallen in a pool are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 5,325,086 to Thomas; U.S. Pat. No. 5,268,672 to Nelson et al.; U.S. Pat. No. Des. 359,702 to Brandon; U.S. Pat. No. 5,121,104 to Nelson et al.; U.S. Pat. No. 5,115,222 to Peralta et al.; and U.S. Pat. No. 5,049,859 to Arnell.

In this respect, the pool monitoring system according to the present invention substantially departs from the conventional concepts and designs of the prior art, and in so doing provides an apparatus primarily developed for the purpose of monitoring a pool from afar.

Therefore, it can be appreciated that there exists a continuing need for a new and improved pool monitoring system which can be used for monitoring a pool from afar, wherein the pool is monitored with a submerged microphone adapted to detect sounds indicative of a person. Further, there is a need for a pool monitoring system which is active by default and can only be temporarily deactivated. In this regard, the present invention substantially fulfills this need.

SUMMARY OF THE INVENTION

In view of the foregoing disadvantages inherent in the known types of pool monitoring devices now present in the prior art, the present invention provides an improved pool monitoring system. As such, the general purpose of the present invention, which will be described subsequently in greater detail, is to provide a new and improved pool monitoring system which has all the advantages of the prior art and none of the disadvantages.

To attain this, the present invention essentially comprises a durable buoyant device adapted to be attached to a perimeter of a body of water. As shown in FIG. 1, the device has an upper portion adapted to reside above the water and a lower portion adapted to reside below the water. Coupled to the device is a monitoring unit. The monitoring unit includes sound detection means adapted to transmit an alarm signal upon the detection of an audible sound within the body of water. The audible sound has a predetermined intensity. As shown in FIG. 3, the detection means includes a microphone submerged in the water for detecting sound therein and transmitting a sound signal indicative thereof. The microphone is ideally situated on the surface of the housing of the monitoring unit. Connected to the microphone is a sensitivity selector for amplifying the sound signal received from the microphone a predetermined amount. An envelope detector is connected to the sensitivity selector for transmitting a average sound signal having a level equal to an average intensity of the sound. Finally, a voltage compressor is connected to the envelope detector for transmitting the alarm signal only upon the average sound signal being transmitted from the envelope detector surpassing a predetermined level. A further component of the monitoring unit is a timer deactivation means having a first mode of operation and a second mode of operation. During the first mode of operation, an activation signal is transmitted. It is imperative that the activation signal be transmitted only while the timer deactivation means is maintained in the first mode of operation. The timer deactivation means further has a second mode of operation initiated by the receipt of a timer deactivation signal via free space. The timer deactivation means is maintained in the second mode of operation during a time period inherent in the timer deactivation signal. Further associated with the monitoring unit is battery power monitoring means connected to a battery which powers the monitoring unit. The battery monitoring means is adapted to transmit a battery low signal upon the power delivered by the battery falling below a predetermined level. The monitoring unit further includes a transmitter means connected to the sound detection means, timer deactivation means, and the battery power monitoring means. The transmitter means is adapted to transmit via free space a remote alarm activation signal upon the receipt of the alarm signal from the sound detection means coincident with the receipt of the activation signal from the timer deactivation means. Additionally, the transmitter is adapted to transmit via free space a remote alarm activation signal upon the receipt of the battery low signal from the battery power monitoring means. For indication of which mode of operation the timer deactivation means and monitoring unit are operating in, status indication means is connected to the timer deactivation means for providing a first visual signal upon the receipt of the activation signal and further transmitting a second visual signal upon the lack of receipt of the activation signal. For alerting a user proximate the body of water that a body has fallen into the pool, alarm indication means is connected to the sound detection means and timer deactivation means. The alarm indication means is adapted for transmitting an audible noise upon the receipt of the alarm signal from the sound detection means coincident with the receipt of the activation signal from the timer deactivation means. Further included is a remote alarm unit situated distant the monitoring unit. The remote alarm unit includes timer selection means adapted to transmit via free space the deactivation signal indicative of a predetermined time period. It should be noted that the predetermined time period is manually selected via the depression of one of a plurality of keys representative of various time periods. The remote alarm unit further includes remote receiver means adapted to generate an audible noise upon the receipt of the remote alarm activation signal via free space.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved pool monitoring system which has all the advantages of the prior art pool monitoring devices and none of the disadvantages.

It is another object of the present invention to provide a new and improved pool monitoring system which may be easily and efficiently manufactured and marketed.

It is a further object of the present invention to provide a new and improved pool monitoring system which is of a durable and reliable construction.

An even further object of the present invention is to provide a new and improved pool monitoring system which is susceptible of a low cost of manufacture with regard to both materials and labor, and which accordingly is then susceptible of low prices of sale to the consuming public, thereby making such pool monitoring system economically available to the buying public.

Still yet another object of the present invention is to provide a new and improved pool monitoring system which provides in the apparatuses and methods of the prior art some of the advantages thereof, while simultaneously overcoming some of the disadvantages normally associated therewith.

Still another object of the present invention is to monitor a pool from afar with a submerged microphone adapted to detect sounds indicative of a person.

Yet another object of the present invention is provide a pool monitoring system which is active by default and can only be temporarily deactivated.

Lastly, it is an object of the present invention to provide a new and improved pool monitoring system including a monitoring unit with a detection mechanism adapted to transmit an alarm signal upon the detection of a human falling within the body of water. Further provided is a timer deactivation mechanism having a first mode of operation during which an activation signal is transmitted, wherein the activation signal is transmitted only while the timer deactivation mechanism is maintained in the first mode of operation. The timer deactivation mechanism further has a second mode of operation initiated by the receipt of a timer deactivation signal via free space. The timer deactivation mechanism is further maintained in the second mode of operation during a time period inherent in the timer deactivation signal. Also included is a transmitter mechanism connected to the sound detection mechanism and timer deactivation mechanism. The transmitter mechanism is adapted to transmit via free space a remote alarm activation signal upon the receipt of the alarm signal from the sound detection mechanism coincident with the receipt of the activation signal from the timer deactivation mechanism. A remote alarm unit is situated distant the monitoring unit and includes a timer selection mechanism adapted to transmit via free space the deactivation signal indicative of the predetermined time period. The remote alarm unit further includes a remote receiver mechanism adapted to generate an audible noise upon the receipt of the remote alarm activation signal via free space.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
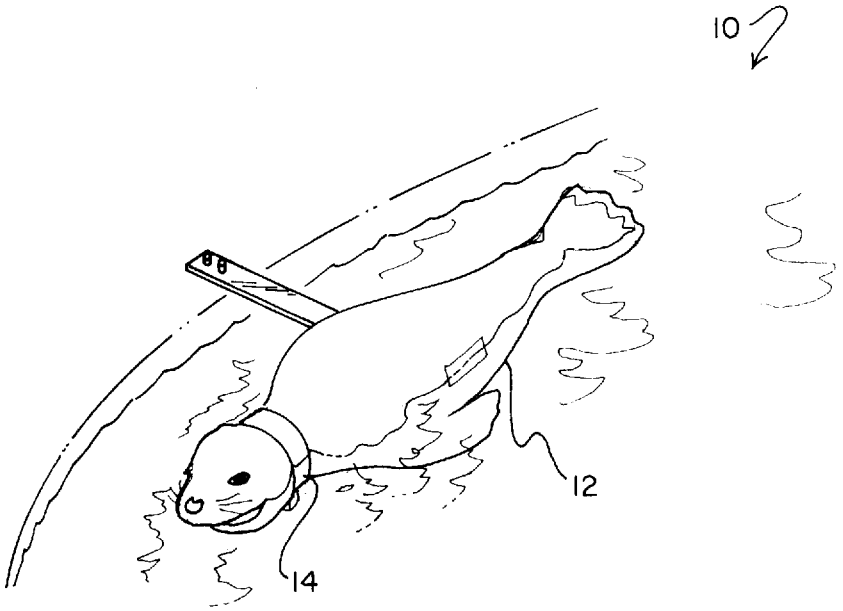
FIG. 1 is a perspective illustration of the preferred embodiment of the pool monitoring system constructed in accordance with the principles of the present invention.
Figure 2:
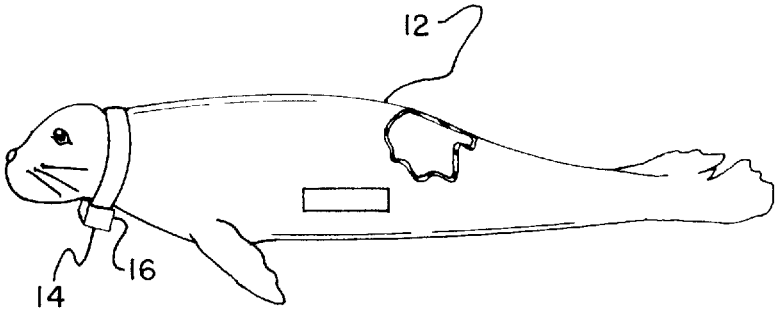
FIG. 2 is a side view of the device of the present invention.

With reference now to the drawings, and in particular to FIG. 1 thereof, a new and improved pool monitoring system embodying the principles and concepts of the present invention and generally designated by the reference numeral 10 will be described.

The present invention, the new and improved pool monitoring system, is comprised of a plurality of components. Such components in their broadest context include a durable buoyant device, monitoring unit, and remote alarm unit. Such components are individually configured and correlated with respect to each other so as to attain the desired objective.

More specifically, it will be noted that the system 10 of the present invention includes a durable buoyant safety device 12 adapted to be attached to a perimeter of a body of water. Such attachment is preferably accomplished by way of a rigid strip having a first end coupled to an upper periphery of a pool or the like and a second end mounted to the safety device 12. See FIG. 1. As shown in FIG. 1, the device has an upper portion adapted to reside above the water and a lower portion adapted to reside below the water. The safety device consists of a durable buoyant structure preferably in the shape of a seal as shown in the Figures.

Figure 3:
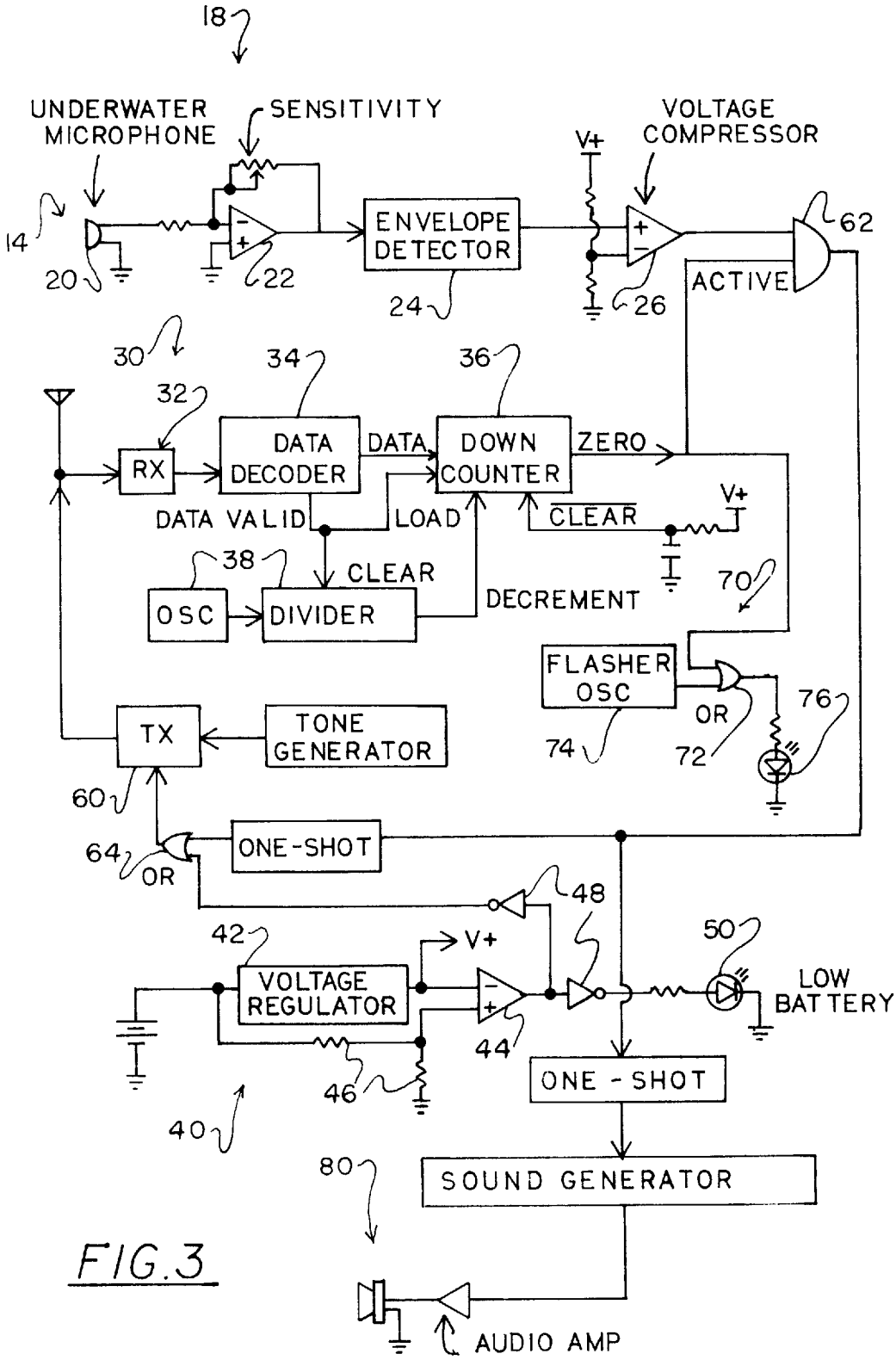
FIG. 3 is a schematic diagram depicting the various electrical components of the monitoring unit of the present invention.

Coupled to the safety device is a monitoring unit 14. The various components associated with the monitoring unit reside within a rectangular housing 16 coupled to the neck of the seal. The monitoring unit includes sound detection means 18 adapted to transmit an alarm signal upon the detection of an audible sound within the body of water. The audible sound has a predetermined intensity. As shown in FIG. 3, the sound detection means includes a microphone 20 submerged in the water for detecting sound therein and transmitting an electric sound signal indicative thereof. The microphone is ideally situated on the surface of the housing of the monitoring unit. Connected to the microphone is a sensitivity selector 22 which takes the form of an operational amplifier with a variable resistor for amplifying the sound signal received from the microphone a predetermined amount. An envelope detector 24 is connected to the sensitivity selector for transmitting an average sound signal having a level equal to an average intensity of the detected sound. Finally, a voltage compressor 26 is connected to the envelope detector for transmitting the alarm signal only upon the average sound signal being transmitted from the envelope detector surpassing a predetermined level. Such alarm signal suitably takes the form of a high pulse. It should be noted that the sensitivity of the sound detection means is afforded by altering the inputted sound signal instead of the envelope detector.

A further component of the monitoring unit is a timer deactivation means 30 having a first mode of operation and a second mode of operation. The timer deactivation means is employed for allowing the user to selectively deactivate the present invention for a predetermined time period during which a user may personally monitor the pool. During the first mode of operation, an activation signal is transmitted by the timer deactivation means. It is imperative that the activation signal be transmitted only while the timer deactivation means is maintained in the first mode of operation. The timer deactivation means further has a second mode of operation initiated by the receipt of a timer deactivation signal via free space. The timer deactivation means is maintained in the second mode of operation during a time period inherent in the timer deactivation signal.

As shown in FIG. 3, the timer deactivation means 30 includes a receiver 32 for receiving the timer deactivation signal via free space. Preferably, the timer deactivation signal is a binary encoded number including 0, 1, 2, or 3. Coupled to the receiver is a data decoder 34 for transmitting to a down counter 36 the decoded timer deactivation signal. The down counter is adapted to have a plurality of descending states starting with the state corresponding to the number received from the data decoder. The down counter only descends to a lower state upon the receipt of a countdown signal. The countdown counter is further adapted to produce the activation signal only upon the state of the down counter being 0. It should be noted that the activation signal takes the form of a high pulse. To effect the countdown of the states of the countdown counter at the appropriate time intervals, an oscillator and divider combination 38 is included that is adapted to deliver the countdown signal every hour starting upon the receipt of the timer deactivation signal. By this design, the countdown counter is adapted to prevent the transmission of the activation signal for a number of hours corresponding to the number received from the data decoder. For example, upon the receipt of the number 3, the countdown counter precludes the transmission of the activation signal for 3 hours. It should be noted that the timer deactivation signal representative of an 0 acts as a reset and effects the transmission of the activation signal immediately.

For improving the integrity of the timer deactivation means, the data decoder is adapted to transmit a data valid signal to the down counter and divider only upon the timer deactivation signal meeting a required protocol. The divider and down counter are only allowed to respond to the timer deactivation signal if the data valid is received therewith from the data decoder.

Further associated with the monitoring unit is battery power monitoring means 40 connected to a battery which powers the monitoring unit. The battery monitoring means is adapted to transmit a battery low signal upon the power delivered by the battery falling below a predetermined level. As shown in FIG. 3, the battery monitoring means includes a voltage regulator 42 coupled between the battery and a negative input of an operational amplifier 44. Further provided is a voltage divider 46 connected between the battery and a positive input of the operational amplifier. By this design, an output of the op-amp goes low upon the battery power falling below a predetermined level as governed by the voltage regulator. A pair of inverters 48 are utilized for transmitting the battery low signal when appropriate. By using the inverter, the battery low signal takes the form of a high pulse. Situated on a side of the device in a waterproof panel is a light emitting diode(LED) 50. Such LED is connected to one of the inverter for signaling upon the receipt of the battery low signal, thereby alerting a user close to the pool.

The monitoring unit further includes a transmitter means 60 connected to the sound detection means, timer deactivation means, and the battery power monitoring means. The transmitter means is adapted to transmit via free space a remote alarm activation signal upon the receipt of the alarm signal from the sound detection means coincident with the receipt of the activation signal from the timer deactivation means. To accomplish such, an AND gate 62 is provided with the inputs thereof connected to the outputs of the timer deactivation means and the sound detection means. Additionally, the transmitter is adapted to transmit via free space a remote alarm activation signal upon the receipt of the battery low signal from one of the inverters of the battery power monitoring means. To allow activation of the transmitter means via either the battery monitoring means or the sound detection means, an OR gate 64 is included with the inputs thereof connected to an output of the AND gate and one of the inverters of the battery power monitoring means.

For indicating which mode of operation the timer deactivation means and monitoring unit are operating in, status indication means 70 is connected to the timer deactivation means for providing a first visual signal upon the receipt of the activation signal and further transmitting a second visual signal upon the lack of receipt of the activation signal. With reference still to FIG. 3, it can be seen that the status indication means includes an OR gate 72 with the inputs thereof connected to the output of the countdown counter of the timer deactivation means and a flasher oscillator 74. Further, a light emitting diode(LED) 76 is connected to the output of the OR gate. By this structure, the LED is adapted to flash while the timer deactivation means is in the first mode of operation thereof and further adapted to remain constant while in the second mode of operation thereof. Preferably, the present LED is situated adjacent the LED of the battery monitoring means within the panel of the device.

For alerting a user proximate the body of water that a body has fallen into the pool, alarm indication means 80 is connected to the sound detection means and timer deactivation means. The alarm indication means is adapted for transmitting an audible noise upon the receipt of the alarm signal from the sound detection means coincident with the receipt of the activation signal from the timer deactivation means. As shown in FIG. 3, the alarm indication means is connected to the output of the AND gate and includes various components such as a sound generator, an audio amp and a speaker, components commonly employed for producing an audible signal.

Figure 4:
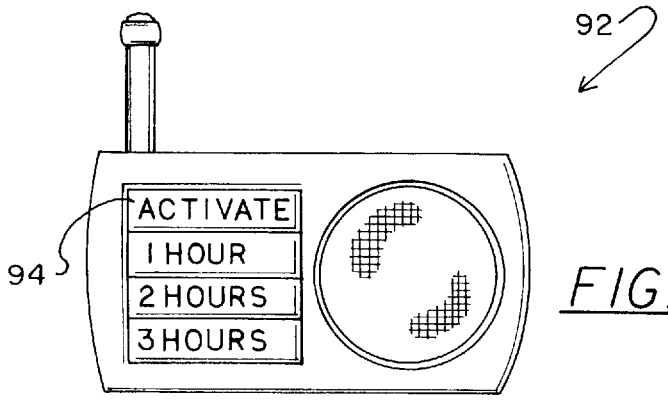
FIG. 4 is a front view of the remote alarm unit of the present invention.
Figure 5:
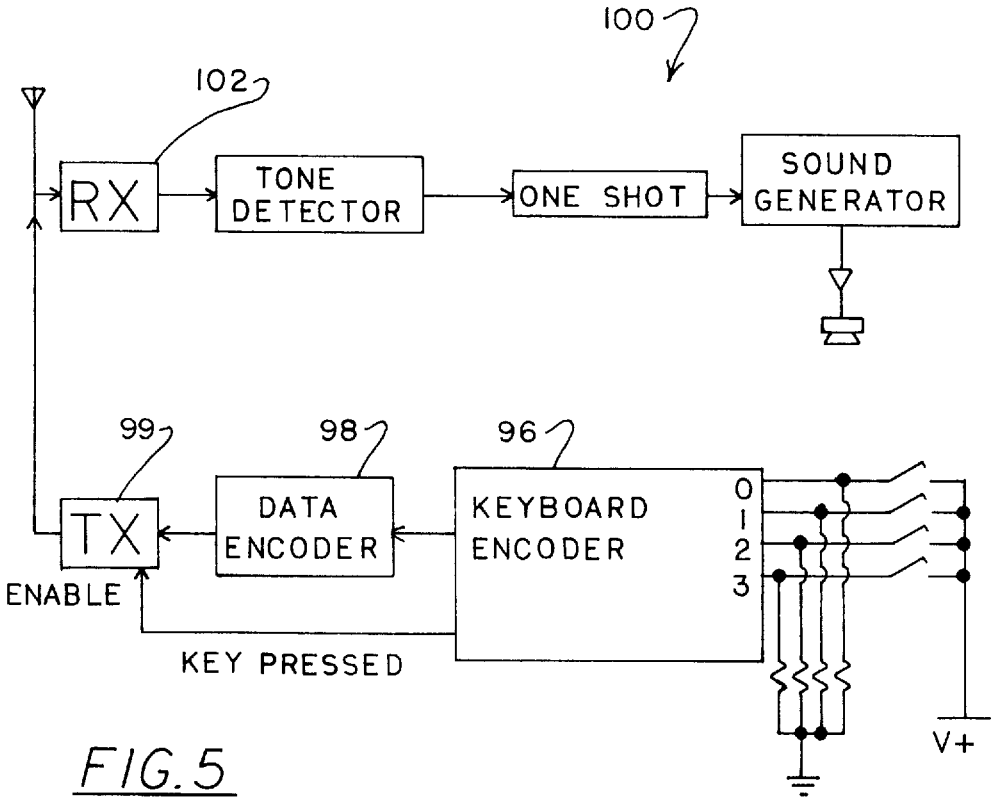
FIG. 5 is a schematic diagram depicting the various electrical components of the remote alarm unit of the present invention.

Further included is a remote alarm unit 90 situated distant the monitoring unit. The remote alarm unit includes timer selection means 92 adapted to transmit via free space the timer deactivation signal indicative of a predetermined time period. It should be noted that the predetermined time period is manually selected via the depression of one of a plurality of keys 94 representative of various time periods. To accomplish the forgoing, a keyboard encoder 96 and data encoder 98 are included for incorporation of an encoded number in the timer deactivation signal before delivering it to a transmitter 99 for transmitting via free space. The keyboard encoder is equipped with a plurality of inputs indicative of numbers between 0–3. Such inputs are activated via keys shown in FIG. 4. As an option, a digital display may be situated on the front face of the remote alarm unit for providing a visual countdown from the number of hours corresponding to the number associated with the activated input of the keyboard encoder. This gives a user an indication of the amount of time until the present invention is again active.

The remote alarm unit further includes remote receiver means 100 adapted to generate an audible noise upon the receipt of the remote alarm activation signal via free space. The receiver means includes components similar to those of the alarm indication means of the monitoring unit for producing an audible sound upon the actuation thereof. The receiver means, however, is actuated by means of a receiver 102 which signals the audio components upon the receipt of the remote alarm activation signal via free space.

The present invention thus utilizes a unique means of detecting when a person has fallen into a body of water such as a pool. Further, a unique method is provided which allows only the temporary deactivation of the present invention when a user desires to manually monitor the pool while it is being used. While the present invention is active, a remote unit affords remote monitoring of the pool. To alert a remote user of the dangerous situation in which the battery is low, the remote alarm unit is adapted to act in a manner similar to the way it responds to the detection of a person falling in the body of water.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved pool monitoring system comprising, in combination:

a durable buoyant device adapted to be attached to a perimeter of a body of water, the having an upper portion adapted to reside above the water and a lower portion adapted to reside below the water;

a monitoring unit coupled to the device and including:

sound detection means adapted to transmit an alarm signal upon the detection of an audible sound within the body of water, the audible sound having a predetermined intensity, timer deactivation means having a first mode of operation during which an activation signal is transmitted, wherein the activation signal is transmitted only while the timer deactivation means is maintained in the first mode of operation, the timer deactivation means further having a second mode of operation initiated by the receipt of a timer deactivation signal via free space and further maintained in the second mode of operation during a time period inherent in the timer deactivation signal, battery power monitoring means connected to a battery which powers the monitoring unit, the battery monitoring means adapted to transmit a battery low signal upon power delivered by the battery falling below a predetermined level, transmitter means connected to the sound detection means, timer deactivation means, and the battery power monitoring means, the transmitter means adapted to transmit via free space a remote alarm activation signal upon the receipt of the alarm signal from the sound detection means coincident with the receipt of the activation signal from the timer deactivation means, the transmitter further adapted to transmit via free space a remote alarm activation signal upon the receipt of the battery low signal from the battery power monitoring means, status indication means connected to the timer deactivation means adapted to provide a first visual signal upon the receipt of the activation signal and further transmit a second visual signal upon the lack of receipt of the activation signal, and alarm indication means connected to the sound detection means and timer deactivation means for transmitting an audible noise upon the receipt of the alarm signal from the sound detection means coincident with the receipt of the activation signal from the timer deactivation means; and a remote alarm unit situated distant the monitoring unit and including:

timer selection means adapted to transmit via free space the deactivation signal indicative of a predetermined time period, whereby the predetermined time period is manually selected via the depression of one of a plurality of keys representative of various time periods, and remote receiver means adapted to generate an audible noise upon the receipt of the remote alarm activation signal via free space.

2. A pool monitoring system comprising:

a body of water;

a monitoring unit including:

detection means adapted to transmit an alarm signal upon the detection of a human falling within the body of water, timer deactivation means having a first mode of operation during which an activation signal is transmitted, wherein the activation signal is transmitted only while the timer deactivation means is maintained in the first mode of operation, the timer deactivation means further having a second mode of operation initiated by the receipt of a timer deactivation signal via free space and further maintained in the second mode of operation during a time period inherent in the timer deactivation signal, and transmitter means connected to the sound detection means and timer deactivation means, the transmitter means adapted to transmit via free space a remote alarm activation signal upon the receipt of the alarm signal from the sound detection means coincident with the receipt of the activation signal from the timer deactivation means; and a remote alarm unit situated distant the monitoring unit and including:

timer selection means adapted to transmit via free space the deactivation signal indicative of the predetermined time period, and remote receiver means adapted to generate an audible noise upon the receipt of the remote alarm activation signal via free space.

3. A pool monitoring system as set forth in claim 2 and further including a durable buoyant device adapted to be attached to a perimeter of a body of water, the device having an upper portion adapted to reside above the water and a lower portion adapted to reside below the water, the monitoring unit coupled to the device.

4. A pool monitoring system as set forth in claim 2 wherein the monitoring unit further includes battery power monitoring means connected to a battery which powers the monitoring unit, the battery monitoring means adapted to transmit a battery low signal upon power delivered by the battery falling below a predetermined level, whereby the transmitter is further adapted to transmit via free space a remote alarm activation signal upon the receipt of the battery low signal from the battery power monitoring means.

5. A pool monitoring system as set forth in claim 2 wherein the monitoring unit further includes status indication means connected to the timer deactivation means adapted to provide a first visual signal upon the receipt of the activation signal and further transmit a second visual signal upon the lack of receipt of the activation signal.

6. A pool monitoring system as set forth in claim 2 wherein the monitoring unit further includes alarm indication means physically connected to the sound detection means and timer deactivation means for transmitting an audible noise upon the receipt of the alarm signal from the sound detection means coincident with the receipt of the activation signal from the timer deactivation means.

7. A pool monitoring system as set forth in claim 2 whereby the predetermined time period is manually selected via the depression of one of a plurality of keys on the remote alarm unit representative of various time periods.

8. A pool monitoring system comprising:

a body of water;

a monitoring unit including:

detection means adapted to transmit an alarm signal upon the detection of a human falling within the body of water, and transmitter means connected to the detection means, the transmitter means adapted to transmit via free space a remote alarm activation signal upon the receipt of the alarm signal from the detection means; and a remote alarm unit situated distant the monitoring unit and including remote receiver means adapted to generate an audible noise upon the receipt of the remote alarm activation signal via free space;

said detection means including a microphone submerged in the water for detecting sound therein and transmitting a sound signal indicative thereof, a sensitivity selector connected to the microphone for amplifying the sound signal a predetermined amount, an envelope detector connected to the sensitivity selector for transmitting a average sound signal having a level equal to an average intensity of the sound, and a voltage compressor connected to the envelope detector for transmitting the alarm signal only upon the average sound signal being transmitted from the envelope detector surpassing a predetermined level.

* * * * *